United States Patent [19]

Constantino

[11] Patent Number: 4,472,819

[45] Date of Patent: Sep. 18, 1984

[54] CAN COUNTER

[75] Inventor: Nicholas Constantino, Richmond, Va.

[73] Assignee: Reynolds Metals Company, Richmond, Va.

[21] Appl. No.: 380,278

[22] Filed: May 20, 1982

[51] Int. Cl.[3] ..... G07F 7/06
[52] U.S. Cl. ..... 377/6; 194/4 C
[58] Field of Search ..... 377/6; 194/4 C

[56] References Cited

U.S. PATENT DOCUMENTS 4,248,334 2/1981 Hanley et al. ..... 194/4 C
4,324,325 4/1982 DeWoolfson ..... 194/4 C

*Primary Examiner*—John S. Heyman
*Assistant Examiner*—N. Biase
*Attorney, Agent, or Firm*—Alan T. McDonald

[57] ABSTRACT

Apparatus for receiving, counting and compensating for aluminum can bodies is disclosed. The apparatus includes means for differentiating between aluminum and steel cans, means for storing accumulated can bodies and output means by which the customer is paid for the aluminum cans fed into the apparatus.

11 Claims, 2 Drawing Figures

CAN COUNTER

BACKGROUND OF THE INVENTION

In the past several years, recycling of valuable materials, and especially aluminum, has become a major industry. Thus, more and more families are now separating beverage and beer cans from the rest of their trash and returning the cans for payment.

At first, consumers had only the choice of returning the cans to a permanent or mobile recycling center. The consumer collected bags of cans at home and delivered these bags to the recycling center, where, in the case of a mobile center, the bags were weighed and the customer paid on a per pound basis. In the case of the permanent center, the bags were emptied, the aluminum and steel cans separated, and the customer paid on a per pound basis for the aluminum cans.

While this method of can collection is still by far the most popular one, it has certain disadvantages for both the consumer and the operator. First, the recycling locations are not always at convenient locations, due to zoning and other considerations, requiring travel on the part of the consumer to the recycling facilities. This, in turn, leads to less frequent trips, resulting in great numbers of cans being stored at home prior to a trip to the recycling center. These disadvantages for the consumer, it is believed, results in a lower rate of return than could be realized if the recycling were made easier for the consumer.

On the other hand, this recycling method has disadvantages for the recycler, as well. Since cans are brought to mobile centers in large quantities, there is no time to permit an evaluation as to whether a given can is aluminum or steel. Nor does the mobile center have the equipment necessary for efficiently separating aluminum and steel cans. Thus, when a bag of cans is weighed, the recycler often pays for steel cans that it does not desire, as well as the desired aluminum cans.

Another method for aluminum can recycling which is becoming increasingly popular is the use of the "reverse vending" machine. In such an apparatus, the consumer feeds cans to a machine, either in groups or individually, with the machine separating aluminum and steel cans, weighing the aluminum cans and paying the consumer for the weight of the aluminum received. These machines may be set up in shopping center parking lots, and the like, making the recycling locations more accessible to the consumer.

This equipment, however, is expensive, being in the order of 25 to 30 thousand dollars per unit, making the investment high on the part of the recycler. The high cost results from the need of the equipment to withstand vandalism and extraneous materials placed into the machine.

Recently, recycling has begun in the neighborhood grocery store. The consumer again brings a bag or bags of cans to the recycling location, which is now the local supermarket, where the cans are weighed and the customer is paid based upon the weight of the cans. The convenience of this method permits more frequent trips for the consumer and thus reduces storage requirements on the part of the consumer. This method, however, requires the supermarket to invest time and labor in the recycling operation and again makes no provision for isolating aluminum from steel cans, making it a costly investment for the store. The method has the advantage, however, of bringing recycling ability to every neighborhood, thus increasing the level of recycling activity.

It is desirable, therefore, to produce an apparatus which could be placed in supermarkets and the like, to differentiate between aluminum and steel cans, and provide a count of aluminum cans for which payment is due. This apparatus should be low in cost and maintenance, thus reducing investment for the recycler and labor costs for the supermarket.

THE PRESENT INVENTION

By means of the present invention, these desired results are obtained.

The apparatus of the present invention comprises means for counting cans entering the apparatus, means for differentiating between aluminum and steel cans, means for collecting the cans fed to the apparatus, and means for indicating payment to be made. The apparatus is far less expensive than complete "reverse vending" machines. This is due to the lack of a need for separating cans from other trash and the lack of need to handle multiple cans at one time. In the supermarket, more frequent trips, and thus fewer cans per trip, enable the apparatus to operate at the rate of one can at a time, and little likelihood of extraneous trash being fed to the unit eliminates a need for the involved separation apparatus required in complete reverse vending machines.

BRIEF DESCRIPTION OF THE DRAWINGS

The apparatus of the present invention will be more fully described with reference to the drawings in which.

DETAILED DESCRIPTION OF THE PREFERRED EMBODIMENT

Figure 1:
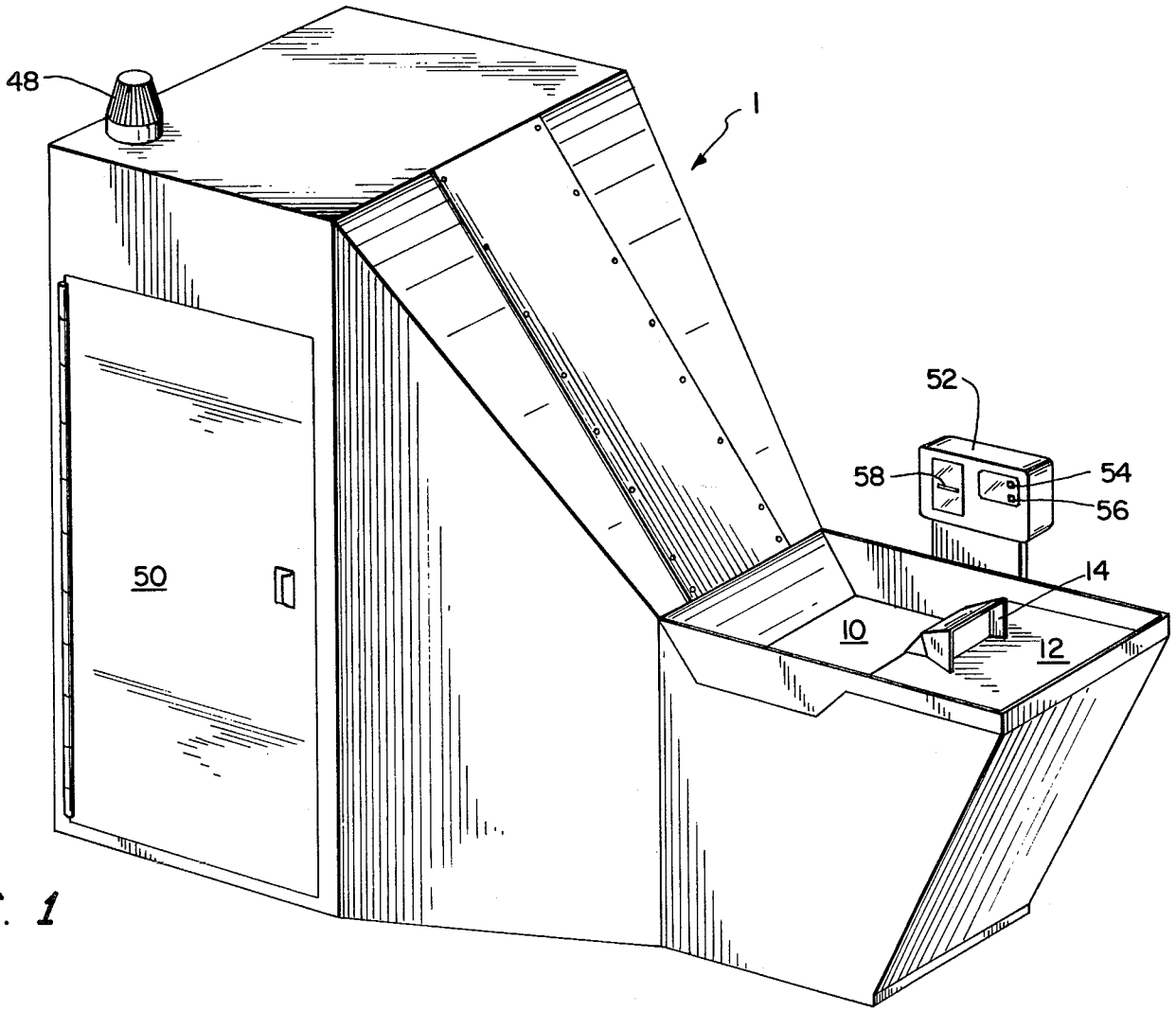
FIG. 1 is a prospective view of the apparatus of the present invention.
Figure 2:
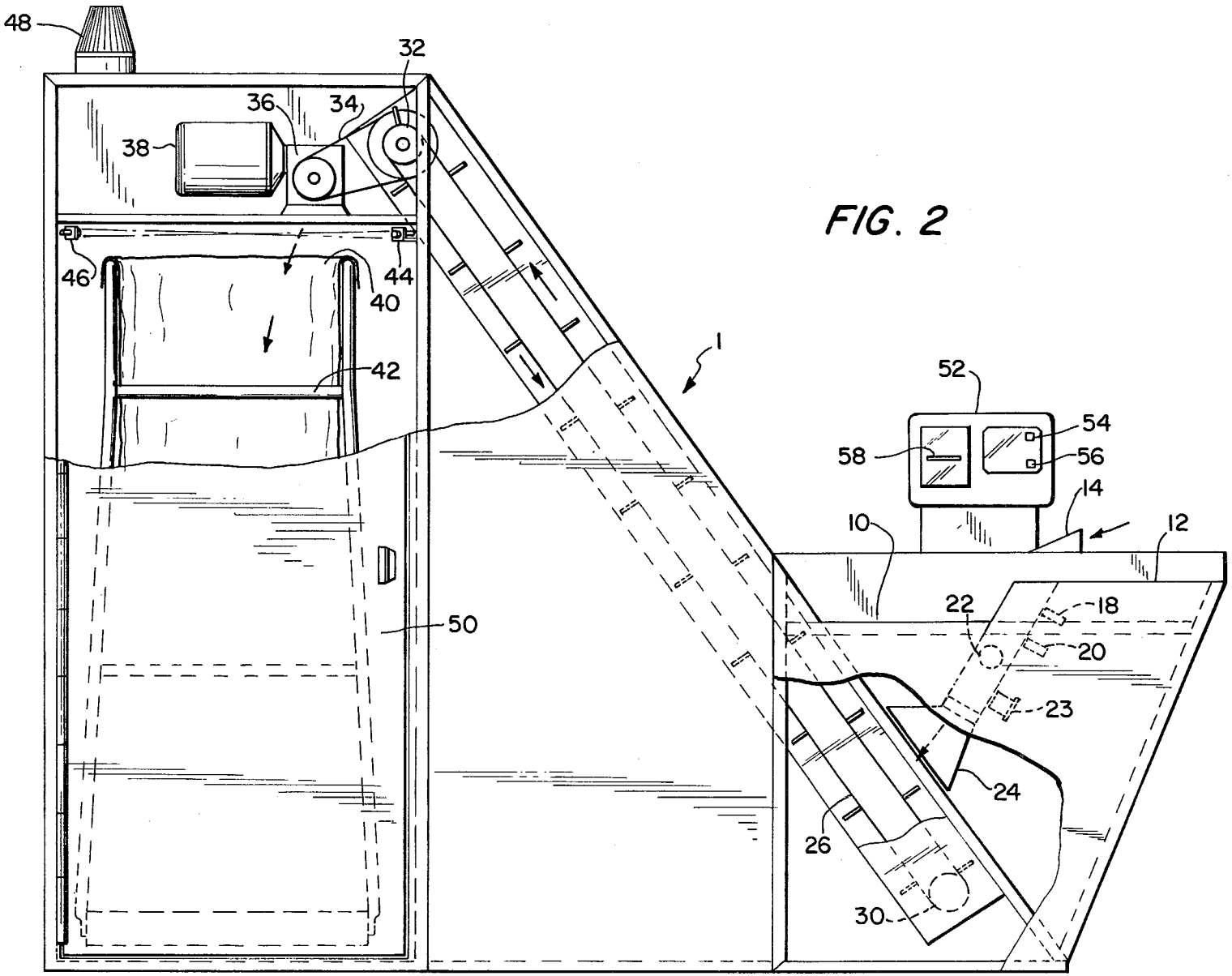
FIG. 2 is a side elevational view, with the front panels removed to illustrate the interior of the apparatus.

Turning to the FIGURES, a can counter 1 of the present invention is illustrated.

A sorting table 10 and feed table 12 are located adjacent can entrance 14. A customer may dump a bag of cans onto table 10 and, after pushing start button 54, feed them individually into entrance opening 14.

At this point, some discussion must be made concerning the cans which are fed to the system. Cans currently in production are in one of three forms. They may comprise an aluminum body with an aluminum closure end, a steel body with an aluminum closure end, or a steel body with a steel closure end. There are practically no aluminum can bodies with steel ends.

The form of the can reaching the apparatus 1 may also be in of three conditions. The can may be uncrushed, it may be partially or completely crushed along its sidewalls, producing a generally flat member, or the can may be crushed from end to end, resulting in a generally disk-shape or "hockey puck". The apparatus of the present invention must be able to distinguish aluminum cans from steel cans in any of these forms.

After entering entrance opening 14, the can body, in any of the three aforementioned forms, passes along a passageway in the form of a chute 16. As it passes along this chute, the can affects several sensors which will now be described.

Sensor 18 is an aluminum sensor. This sensor is normally on after the customer has pushed on button 54. If an all aluminum can passes over the sensor 18, the sensor sends a count of one to an aluminum counter within a counting means 52 and activates side steel sensor 20, which is in a normally off condition, deactivates bottom steel sensor 22, which is in a normally on condition, and activates light sensor 23. As an all aluminum can passes steel sensors 20 and 22, no signal results. Finally, the can breaks a photoelectric beam from sensor 23, which signals the two steel sensors to return to their normal positions and shuts itself off. The can then passes through exit chute 24 to be further processed as described below.

If an all steel can passes through the system, the aluminum sensor 18 does not register. When it passes over the steel sensors, sensor 22, being normally on, sends a count to the steel counter within counting means 52. This steel count is to inform the consumer of the number of steel cans that were passed through the system and for which payment was not made. The steel can then passes through the photoelectric beam 23, which is in its normally off position, thereby having no effect. Finally, the can passes through exit chute 24 to be further processed as will be described below.

The third situation results from a steel can with an aluminum end. In this situation, the can passes over the aluminum sensor 18, giving a count of one to the aluminum counter in counting means 52 as the sensor 18 sees the aluminum end. Sensor 20 and photoelectric beam 23 are then activated, with sensor 22 being deactivated. Sensor 20 registers the steel can body passing through chute 16 and sends a minus one count to the aluminum counter and a one count to the steel counter within counting means 52. The can then passes across photoelectric beam 23, returning the steel sensors to their original positions and turning itself off. Finally, the can passes through exit chute 24 to be further processed as described below.

The two steel sensors 20 and 22 are preferably positioned at approximately right angles to one another. This permits the apparatus to sense cans in an uncrushed, a side crushed, or a end crushed "hockey puck" position, whether the can is fed lengthwise or widthwise.

As will be readily realized, only aluminum can bodies with aluminum ends are paid for by this system. Steel cans with steel ends or steel cans with aluminum ends are uncompensated.

After passing the last can to the apparatus, the consumer presses stop button 56. Alternatively, the apparatus 1 could include a timing means such that if no can count, either steel or aluminum, is received by counting means 52 within a given time, the apparatus 1 automatically finishes the transaction.

In either situation, the transaction is completed by the counting means 52 providing a printed result of the transaction through a printing means (not shown) exiting through slot 58. This report includes the total number of aluminum cans for which payment is to be made, the amount to be paid per can, the total amount due and the number of steel cans for which no payment is to be made. The counting means 52 is preferably a microprocessor which has been programmed, by conventional means, to count the steel and aluminum cans. The amount to be paid per can may be set by the store operator at the desired level and changed by rate varying means, such as thumb wheels connected to the counting mechanism 52 (not shown). The system may compensate at either an even or a fractional number of cents per can. The customer takes the receipt exiting from slot 58 to a cashier or other designated person in the store, where payment is made.

An alternative to the receipt mechanism 58 would include a payout mechanism, including, for example, means for paying out pennies, nickels and quarters, so that direct payment could be made from the apparatus. Such a means, however, substantially adds to the cost of the unit and is not preferred.

As the cans exit exiting chute 24, they are captured by cleated endless belt 26, which belt 26 passes over pulleys 30 and 32. Pulley 32 is a driven pulley, being driven by means of belt or chain 34 connected to a gear box 36 which is in turn connected to motor 38. Motor 38 is activated with the pushing of start button 54 and is deactivated, preferably after a time delay, with the pushing of stop button 56.

The cans exit belt 26 and enter a bag 40. Bag 40 is supported by means of bag support stand 42.

A photoelectric cell 44 and receptor 46 are employed to determine when bag 40 needs to be changed. When bag 40 becomes full, the beam exiting photoelectric cell 44 is broken. It should be noted that beam 44 is out of line with the exit of the cans from belt 26 into bag 40. When the beam is broken, a signal, such as light 48, is activated, advising store personnel that a bag change is necessary. Clearly, an audible signal, such as an alarm buzzer, could be added to or replace light 48.

Lockable door 50 is provided for easy access of store personnel to replace bag 40.

From the foregoing, it is clear that the present invention provides an effective, yet inexpensive, apparatus for receiving used aluminum cans and compensating the consumer therefor.

While the invention has been described with reference with certain specific embodiments thereof, it is not intended to be so limited thereby, except as set forth in the accompanying claims.

I claim:

1. Apparatus for processing metallic cans of either steel or aluminum or a combination thereof, comprising a passageway along which said cans pass, sensing means for detecting the presence of aluminum and steel comprising an aluminum sensor, a pair of steel sensors and a photoelectric cell, counting means connected to said sensing means for determining the number of aluminum and the number of steel cans processed, means for providing an output of said counting means and means for collecting said metallic cans after processing.

2. The apparatus of claim 1 wherein a first of said steel sensors is positioned above a second of said steel sensors and wherein said steel sensors are positioned approximately 90° from one another.

3. The apparatus of claim 2 wherein during processing said aluminum sensor is normally on, said first steel sensor is normally off, said second steel sensor is normally on and said photoelectric cell is normally off.

4. The apparatus of claim 1 wherein said counting means comprises a microprocessor.

5. The apparatus of claim 1 wherein said output means comprises a printer.

6. The apparatus of claim 1 wherein said output means comprises a payout mechanism.

7. The apparatus of claim 1 wherein said collecting means comprises a conveyor having one end thereof positioned at the exit end of said passageway and a bag positioned at the other end of said conveyor.

8. The apparatus of claim 7 further comprising means for detecting and reporting a filled condition of said bag.

9. The apparatus of claim 8 wherein said detecting and reporting means comprises a photoelectric cell positioned above the top of said bag and an alarm connected to said photoelectric cell.

10. The apparatus of claim 9 wherein said alarm comprises a light.

11. The apparatus of claim 9 wherein said alarm comprises an audible sound generator.

* * * * *